US009920591B2

(12) United States Patent
Themig

(10) Patent No.: US 9,920,591 B2
(45) Date of Patent: Mar. 20, 2018

(54) TOE CIRCULATION SUB

(71) Applicant: PACKERS PLUS ENERGY SERVICES INC., Calgary (CA)

(72) Inventor: Daniel Jon Themig, Calgary (CA)

( * ) Notice: Subject to any disclaimer, the term of this patent is extended or adjusted under 35 U.S.C. 154(b) by 706 days.

(21) Appl. No.: 14/382,856

(22) PCT Filed: Mar. 7, 2013

(86) PCT No.: PCT/CA2013/050172

§ 371 (c)(1),
(2) Date: Sep. 4, 2014

(87) PCT Pub. No.: WO2013/131194

PCT Pub. Date: Sep. 12, 2013

(65) Prior Publication Data

US 2015/0075806 A1 Mar. 19, 2015

Related U.S. Application Data

(60) Provisional application No. 61/608,392, filed on Mar. 8, 2012.

(51) Int. Cl.

| | |
|---|---|
| ***E21B 34/14*** | (2006.01) |
| ***E21B 17/00*** | (2006.01) |
| ***E21B 43/10*** | (2006.01) |
| ***E21B 33/12*** | (2006.01) |
| ***E21B 23/10*** | (2006.01) |
| ***E21B 17/14*** | (2006.01) |
| ***E21B 21/10*** | (2006.01) |

(52) U.S. Cl.

CPC ..... *E21B 34/14* (2013.01); *E21B 17/00* (2013.01); *E21B 17/14* (2013.01); *E21B 21/10* (2013.01); *E21B 23/10* (2013.01); *E21B 33/12* (2013.01); *E21B 43/10* (2013.01)

(58) Field of Classification Search

CPC ..... E21B 33/12; E21B 23/10; E21B 34/14; E21B 21/10; E21B 17/14; E21B 17/00; E21B 43/10

See application file for complete search history.

(56) References Cited

U.S. PATENT DOCUMENTS

| | | | | |
|---|---|---|---|---|
| 2,153,034 A | | 4/1939 | Baker | |
| 2,845,130 A | | 7/1958 | Austin | |
| 3,527,299 A | | 9/1970 | Lewis | |
| 4,729,432 A | | 3/1988 | Helms | |
| 4,789,032 A | | 12/1988 | Rehm et al. | |
| 5,117,910 A | * | 6/1992 | Brandell | E21B 33/126 166/154 |

(Continued)

OTHER PUBLICATIONS

Team Oil Tools, www.teamoiltools.com/Innovation/TEAM-Patents, I-Circulation Sub, 2012.

*Primary Examiner* — Nicole Coy

(57) ABSTRACT

A toe circulation sub for a wellbore liner, the toe circulation sub comprising: a body including a connection for connecting the body to a wellbore liner to define an inner facing portion open to an inner diameter of the liner and an outer facing portion open to an outer surface of the liner; a bore through the body from the inner facing portion to the outer facing portion; and, a ball seat in the bore formed to stop and seal with a ball to plug flow through the bore to close the toe circulation sub. The toe circulation sub is useful for methods and may be installed in a wellbore liner.

16 Claims, 4 Drawing Sheets

(56) References Cited

U.S. PATENT DOCUMENTS

| | | | | |
|---|---|---|---|---|
| 5,318,118 | A * | 6/1994 | Duell | E21B 33/126 166/202 |
| 6,131,662 | A | 10/2000 | Ross | |
| 6,253,861 | B1 * | 7/2001 | Carmichael | E21B 21/103 175/237 |
| 8,931,565 | B2 * | 1/2015 | Desranleau | E21B 34/14 166/320 |
| 2004/0084182 | A1 * | 5/2004 | Edgar | E21B 21/10 166/285 |
| 2010/0132954 | A1 | 6/2010 | Telfer | |
| 2011/0100647 | A1 | 5/2011 | King et al. | |
| 2011/0290344 | A1 | 12/2011 | Groesbeck et al. | |
| 2012/0073827 | A1 | 3/2012 | Kenyon et al. | |

* cited by examiner

TOE CIRCULATION SUB

FIELD

The invention is directed to a wellbore apparatus and method and, in particular a toe circulation sub for a wellbore liner and a method.

BACKGROUND

While running in a liner string it is advantageous to circulate fluids through the liner and through its distal end. A toe circulation sub, also called a toe sub, may be installed at the distal end of the liner.

This fluid flow helps to keep any debris that is loose in the well from stopping the liner from progressing downhole. If the toe sub gets plugged then the flow is stopped and the liner may get stuck while running in. The toe sub also serves the purpose of allowing cleaning of any drilling mud from the openhole on the outside of the liner before the packers are set. A typical toe sub has a torturous path through it and, thus, it is prone to clogging. The closing of this toe sub is actuated by the use of a ball. This ball is dropped from the surface and pumped down to the toe sub. Once it contacts the seat in the toe sub it closes the flow path. This closed flow path creates a piston. The piston is pushed down by the applied pressure. Once the piston moves down the flow path is closed from the liner to the openhole. This is permanently closed and can't be re-opened. The ball is loose in the liner and can roll back down the liner and possibly get in the way of intervention tools.

SUMMARY OF THE INVENTION

A toe sub is disclosed that overcomes one or more difficulties of the prior toe subs.

In accordance with a broad aspect of the invention, there is provided a toe circulation sub comprising: toe circulation sub for a wellbore liner, the toe circulation sub comprising: a body including a connection for connecting the body to a wellbore liner to define an inner facing portion open to an inner diameter of the liner and an outer facing portion open to an outer surface of the liner; a bore through the body from the inner facing portion to the outer facing portion; and, a ball seat in the bore formed to stop and seal with a ball to plug flow through the bore to close the toe circulation sub.

There is also provided a wellbore liner comprising: a liner string including an outer surface, an inner diameter, a long axis and a distal end; a toe circulation sub connected at the distal end of the liner string, the toe circulation sub including: a body including a connection connecting the body to the liner string to define an inner facing portion open to the inner diameter of the liner string and an outer facing portion open to the outer surface of the liner string; a bore through the body from the inner facing portion to the outer facing portion; and, a ball seat in the bore; and, a ball sized to be stopped by and seal against the ball seat to plug flow through the bore to close the toe circulation sub.

There is also provided a method for wellbore operations, comprising: installing a liner with a toe circulation sub connected at a distal end of the liner; circulating fluid through the liner and out through a bore in the toe circulation sub and into an annulus between a wall of the wellbore and the liner; launching a ball to pass through the liner and to plug the bore to circulation; and retaining the ball in the bore.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly the drawings and detailed description are to be regarded as illustrative in nature and not as restrictive.

BRIEF DESCRIPTION OF THE DRAWINGS

A further, detailed, description of the invention, briefly described above, will follow by reference to the following drawings of specific embodiments of the invention. These drawings depict only typical embodiments of the invention and are therefore not to be considered limiting of its scope. In the drawings.

DESCRIPTION OF VARIOUS EMBODIMENTS

Figure 1:
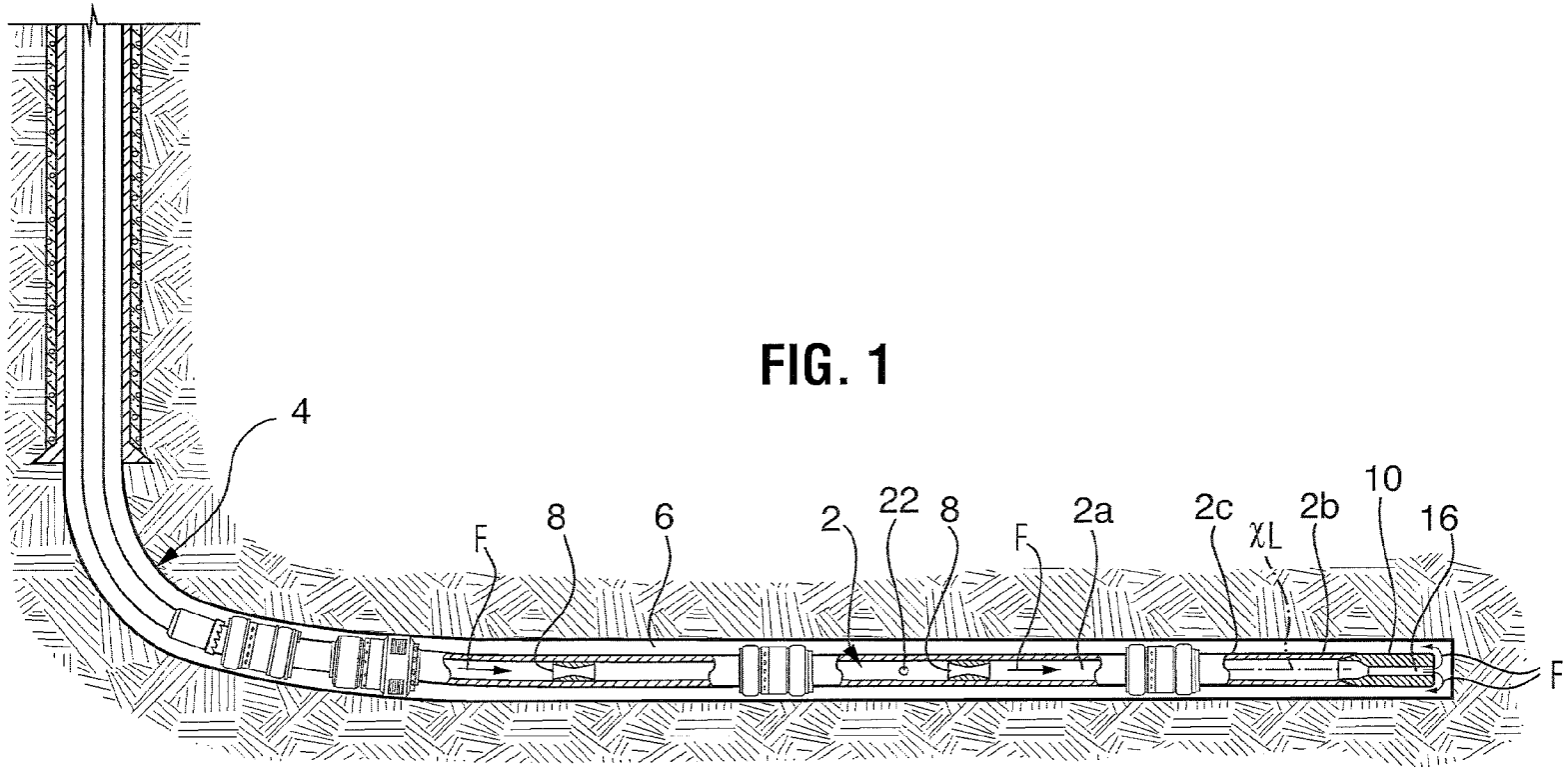
FIG. 1 is a schematic view of a liner string in a wellbore.
Figure 2:
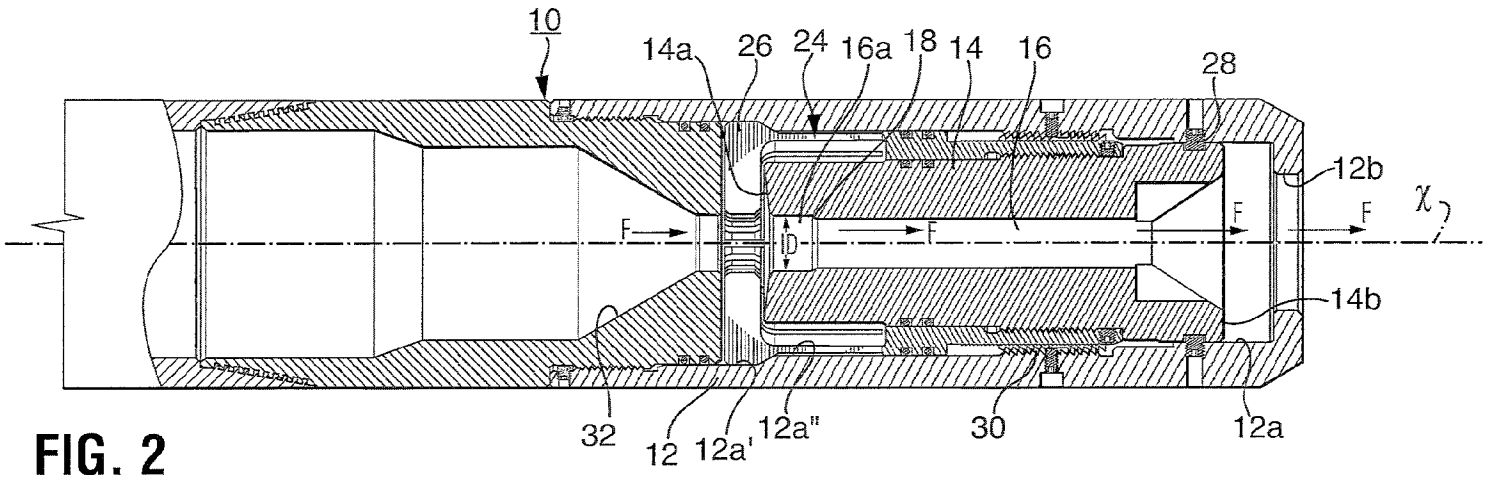
FIG. 2 is a sectional view along the long axis of a toe circulation sub in a run-in condition.

The description that follows and the embodiments described therein are provided by way of illustration of an example, or examples, of particular embodiments of the principles of various aspects of the present invention. These examples are provided for the purposes of explanation, and not of limitation, of those principles and of the invention in its various aspects. In the description, similar parts are marked throughout the specification and the drawings with the same respective reference numerals. The drawings are not necessarily to scale and in some instances proportions may have been exaggerated in order more clearly to depict certain features With reference to FIG. 1, a liner 2 is shown being positioned in a wellbore, defined by a wellbore wall 4. Fluid circulation is set up through the liner to facilitate its advancement into the wellbore. In this embodiment, forward circulation is employed wherein fluid is circulated as shown by arrows F, down through the bore 2*a* of the liner, out the toe 2*b* of the liner and up through the annulus 6 between the wellbore wall and the outer surface 2*c* of the liner.

A toe circulation sub 10 is placed at the toe, which is the very distal end, of the liner.

The toe circulation sub 10 defines therethrough a flow path 16 that is straight through without bends such as elbows, corners, etc. Being devoid of bends, the toe circulation sub limits, and may eliminate, any plugging issues. This toe sub may therefore be useful with fluids having high solid content. The flow path axis is parallel with the long axis xL of the liner such that flow through both the liner and the toe sub is straight.

The toe circulation sub flow path 16 is open during run in allows circulation down the liner to the annulus, as shown, and even allows reverse circulation from the annulus to the liner.

The toe sub remains open to fluid flow until it is closed. The toe sub is closed by a ball 22 released from above the toe sub, which moves to land in a close off the flow path through the toe sub. The toe sub includes a flow path closing structure including a ball seat in the flow path, which stops and seals with the ball.

The toe sub may also include a ball retainer above the ball seat. The ball retainer is configurable between an inactive condition and an active condition. In the active condition, the ball retainer holds the ball in the flow path.

To close the flow path, a ball is released to land in the seat of the flow path, which plugs the flow. When moving to the ball seat, the ball can pass through any ball actuated devices 8 in the liner and through the ball retainer, which is in its inactive condition. However, once the ball lands in the seat, the ball retainer is actuated to hold the ball from returning upwardly out of the bore, as it is the ball's presence that maintains the toe circulation sub closed. The ball retainer can be activated to hold the ball in the flow path to continue to restrict flow therethrough. This also prevents the ball from becoming loose in the liner, which avoids interference by the ball in other liner and wellbore operations.

In one embodiment, illustrated in FIGS. 2 to 5, a toe sub 10 includes a housing 12 and a piston structure 14 in a bore 12*a* of the housing. The piston structure is axially moveable within the housing from a run-in position (FIG. 2) to a closed position (FIG. 4), against a return 12*b* on an end of the housing. The return acts as a stop wall and retains the piston in the bore of the housing.

A bore 16 extends through the piston. When open, bore 16 defines a fluid flow path, arrows F, extending axially through the piston structure from an upper surface 14*a* to a lower surface 14*b* thereof. Bore 16 extends the full length of piston structure 14 and is continuously parallel along its full length with the long axis x of the piston structure. There are no fully occlusive diverting surfaces in the bore 16, for example no full end walls or corners that the entire bore 16 turns, such that a substantial portion, and possibly substantially all, of the flow through the bore is directly linear from the upper end of the piston to the lower end.

Housing 12 may include an upper end 12*c* formed to be connected to a liner 2. The upper end may be configured to secure the toe sub in a position with axis x of the toe sub coaxial with long axis of the liner. The connection to liner places a portion of the housing and the piston structure exposed to the inner diameter of the liner and an outer facing portion of the toe sub, for example including lower end 14*b* of the piston structure and the end of the housing including returns 12*b*, exposed to the outer surface of the liner and annulus 6.

The walls defining bore 12*a* are portless and bore 16 does not pass through the walls. Bore 16 aligns with an opening between returns 12*b* on the lower end of the housing.

A ball seat 18 is located in the bore. The position of ball seat 18 in the bore defines a uphole portion 16*a* of the bore uphole of the ball seat. Uphole portion 16*a* is that portion of bore 16 between ball seat 18 and upper surface 14*a* of the piston structure. It is noted that the ball seat 18 may be in other positions along the length of the bore.

A ball 22 works with the toe sub and is selected with regard to the ball seat to be sized to enter the chamber but unable to pass ball seat 18. The ball is sized to become sealed up against the ball seat to block the flow path through the bore. The landing of the ball in the ball seat of the bore alone closes flow through the toe sub. The toe sub remains closed to flow from the liner to the annulus as long as the ball remains in the bore. While the term "ball" is used, the ball may not have the exact characteristics of a spherical ball. For example, the ball may be more of a dart, with fins or an elongated form.

Figure 5:
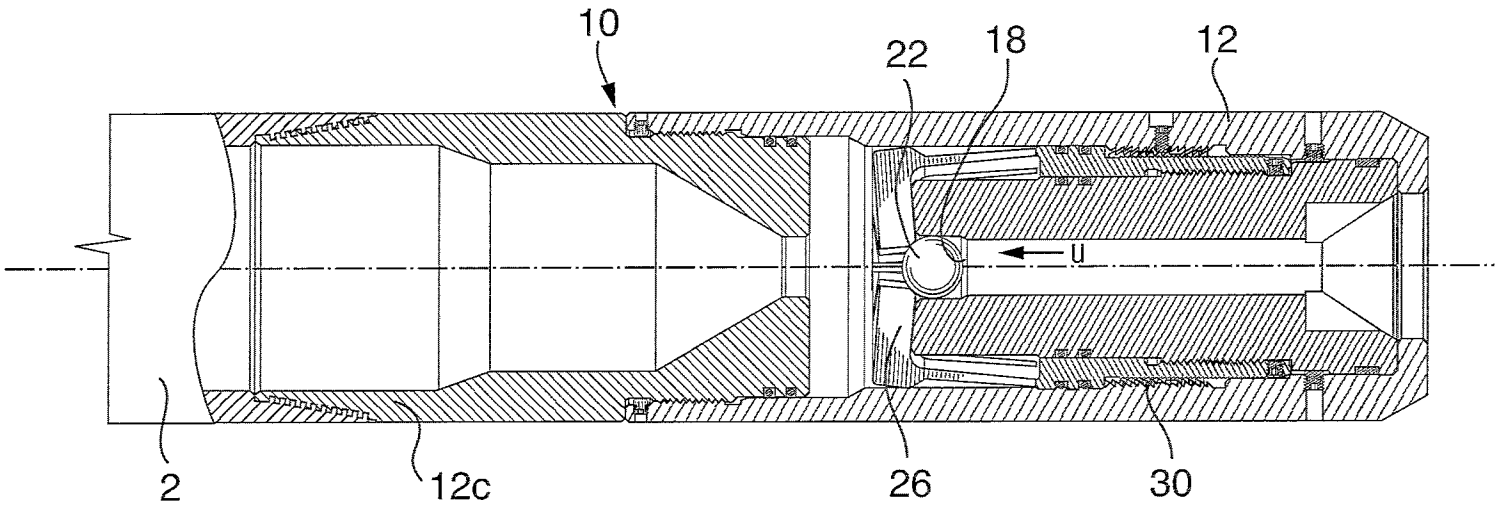
FIG. 5 is a section along the toe circulation sub of FIG. 2 in a closed position, but sealing against reverse flow.

Uphole portion 16*a* of the bore may have an inner diameter ID just larger than the diameter D of ball 22 such that the ball can enter the bore but the ball restricts flow through the bore. Alternately, ball 22 or the material of the piston structure about uphole portion 16*a*, may be somewhat deformable to allow the ball to seal about its diameter with the uphole portion. For example, in one embodiment, ball 22 is deformable such that it can deform to squeeze into the uphole portion of the bore and completely restrict flow through the bore past the ball. Although being deformable in such an embodiment, the ball cannot pass the ball seat, but instead seals against it to block fluid flow therepast. In such an embodiment, flow past the ball downwardly is stopped by ball landing against seat 18 and as shown in FIG. 5, reverse flow upwardly, arrows U, past ball 22 is also stopped as long as the ball remains in bore 16. In one embodiment, once the ball is in place the tubing string pressure can be raised to levels associated with hydraulic tool setting and fracturing.

Figure 4:
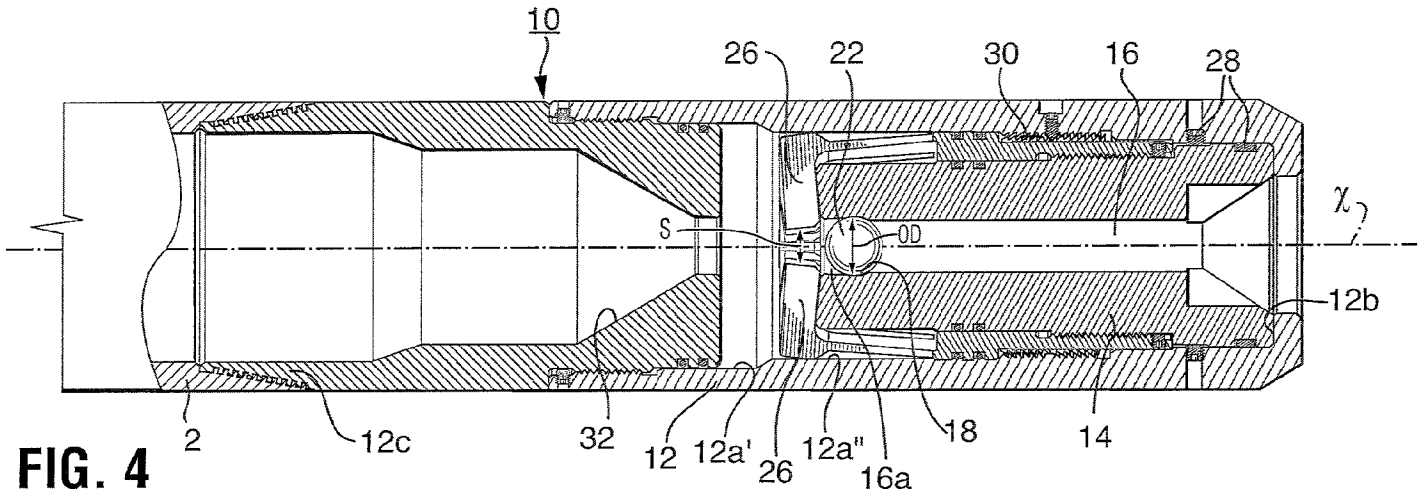
FIG. 4 is a section along the toe circulation sub of FIG. 2 in a closed position.

A ball retainer 24 is positioned at the open, upper end of bore 16 above the ball seat and is actuable between an inactive position (FIGS. 2 and 3: where the ball retainer isn't in a position to act against a ball moving therepast) and an active position (FIG. 4: where the ball retainer resists passage of a ball therepast). The ball retainer in this embodiment, is actuable between the inactive position and the active position by movement of piston structure 14, which is driven by the landing of the ball 22 in the ball seat 18. In this embodiment, the ball retainer 24 is carried on the piston structure and moves therewith through bore 12*a*. In this embodiment, the ball retainer 24 includes a plurality of collet fingers 26 that are initially positioned in a large diameter section 12*a*' of the housing bore, where fingers 26 can expand into the large diameter region and do not protrude across the opening to bore 16. However, fingers 26 are compressed inwardly when the collet fingers are moved to a smaller diameter region 12*a*" of the housing bore. When compressed inwardly (FIG. 4), fingers 26 have a close spacing S less than the inner diameter ID across uphole portion 16*a* of the bore. Fingers 26, thus, protrude across the opening to bore 16 and occlude the bore such that the ball cannot pass out of the bore. The inactive position of the ball retainer corresponds with the run-in condition of the piston structure and the active position of the ball retainer corresponds with the closed position of the piston structure.

Ball seat 18 and ball retainer 24 are positioned such that sufficient space is provided therebetween such that once ball 22 lands in the ball seat, ball retainer 24 can move into an active position and hold ball 22 in the bore. Depending on the desired action of ball 22 after actuating the toe circulation sub to close, the ball retainer may provide space for ball to move out of a sealing position in the bore or, as shown ball retainer 24 may be configured to hold the ball in the bore and thereby continue to hold ball 22 in a position restricting or sealing against flow through bore 16 in both directions. It is to be noted, however, that the bore shape and size at uphole portion 16*a* and the shape of the ball retainer can be formed in many ways to allow the ball to act in bore 16 as a permanent plug, stopping or resisting flow in both directions, or a one-way check valve, stopping flow down past bore but allowing flow up from lower surface 14*b* to upper surface 14*a*.

The toe circulation sub may further include locking structures to control operation. For example, the toe circulation sub may include a releasable lock 28 to hold the piston structure in the run-in position. Releasable lock 28 may include shear pins as shown or other means such as a snap ring, detents, etc. Piston structure 14 can only move when the pressure builds up to apply a sufficient force to overcome the releasable lock.

The toe circulation sub may additionally or alternatively include a final position lock 30 to hold the piston structure in the closed position. Final position lock 30 may include a ratchet, as shown, or other means such as a snap ring, detents, etc. Piston structure 14 once moved, cannot return to an uphole position due to the holding force of lock 30. This ensures that ball retainer 24 continues to hold ball 22 in bore 16.

A funnel can be provided to direct ball 22 toward ball seat 18. In one embodiment, the bore can have a diverging upper end to facilitate entry of ball 22 to bore 16. In the illustrated embodiment, housing 12 includes, as a part of its inner facing surface, an upper end funnel surface 32 that narrows toward the upper surface of piston 14. For example, the upper end funnel surface 32 forms guiding walls that converge towards bore 16.

Piston structure 14 and ball retainer 24 may be formed of durable materials that can withstand the rigors of downhole use. However, in one embodiment, at least some portion of piston structure 14 and possibly portions of ball retainer 24 are formed of drillable materials such that they can be milled out to open up the liner to the wellbore, if desired. If desired, there may be structures to prevent the piston structure from spinning about axis x to facilitate drilling removal.

In operation, toe circulation sub is 10 is attached at the distal end of a liner 2. The liner with the toe sub 10 attached and in the run-in condition with bore 16 open (FIG. 2), is then run into the well while fluids are circulated through toe sub 10 between the liner and the annulus 6.

Figure 3:
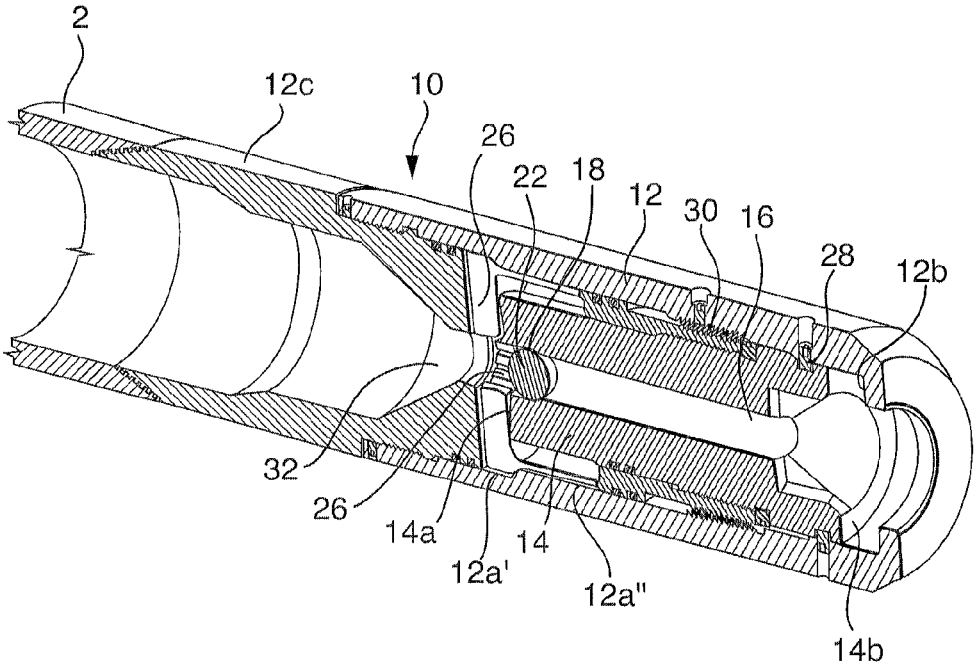
FIG. 3 is an isometric, half sectional view of the toe circulation sub of FIG. 2 in a condition with the ball just landed in the seat.

Once the liner is in position and it is time to close the liner to communication with the annulus, a ball is dropped, introduced to the liner and moved as by pumping or gravity to the toe. This ball flows into uphole portion 16*a* of the bore and lands against the seat 18 (FIG. 3). As shown in FIG. 4, the piston structure is moved axially through bore 12*a* toward returns 12*b* by fluid pressure from above when a ball lands in seat 18 and creates a piston effect across piston structure 14. In particular, when ball 22 lands in the piston structure, the flow is stopped through the bore from the liner to the annulus and a piston face is formed across the ball and piston structure 14. Piston structure 14 is then pushed down by applied fluid pressure against the created piston face once releasable lock 28 is overcome (FIG. 4). Once the ball blocks flow through the bore, the liner inner diameter may be pressure isolated from the annulus, so that tubing pressure can be controlled separately relative to wellbore pressure.

As also shown in FIG. 4, the ball retainer is moved with the piston structure. When ball lands and piston structure 14 moves, fingers 26 move with the piston structure and are pulled from their initial position in larger diameter section 12*a*' to smaller diameter region 12*a*". When the collet moves into the smaller diameter region, the collet fingers move inwardly trapping the ball in bore 16.

The piston structure may be locked in place by lock 30 after moving by fluid pressure, such that the ball remains trapped in the flow path. Ball 22, then remains in bore 16 providing flow control. Since the liner may have other ball actuated devices 8, ball 22 is trapped so it cannot interfere with other operations in the well. If the ball is sized to seal against the bore walls (i.e. for example, the diameter of the ball is the same as or slightly larger than the inner diameter of the bore) and the ball retainer is formed to hold the ball in a sealing position against the bore walls, flow through the toe sub will be stopped in both directions (i) outwardly from the liner to the annulus and (ii) inwardly from the annulus to the liner (FIG. 5).

If desired, the toe sub can be drilled out to open the end of the liner.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

I claim:

1. A toe circulation sub for a wellbore liner, the toe circulation sub comprising:

a body with a central bore defining a flow path and a connection for connecting the toe circulation sub at a distal end of the wellbore liner;

a piston structure in the body having an axially extending bore and a ball seat, wherein upon creation of pressure differential after landing of a ball in the ball seat, the piston structure is axially moveable in the body; and a ball retainer in the path flow adapted to assume:

an inactive position, when the ball retainer assumes a first diameter, wherein fluid is allowed to flow through the flow path past the distal end and into an annulus between the wellbore and the wellbore liner; and an active position, when the ball retainer assumes a second diameter smaller than the first diameter upon axial movement of the piston structure, wherein flow of fluid through the flow path into an annulus is discontinued by the ball being retained in the ball seat, and wherein the ball retainer is to prevent the ball from flowing uphole in the wellbore liner.

2. The toe circulation sub of claim 1 wherein the bore is linear.

3. The toe circulation sub of claim 1 wherein the bore is devoid of fully occlusive diverting surfaces.

4. The toe circulation sub of claim 1 wherein the connection to the wellbore liner is provided at the upper end of the body.

5. The toe circulation sub of claim 1 wherein the ball retainer includes collet fingers moveable adjacent an open upper end of the bore.

6. The toe circulation sub of claim 1 wherein the ball seat has an inner diameter designed to retain the ball in the ball seat to plug flow past the ball.

7. The toe circulation sub of claim 1 further comprising a releasable lock of a retaining force that maintains the piston structure in the inactive position.

8. The toe circulation sub of claim 7, wherein the releasable lock releases the piston structure to move in the active position when a force applied by the ball against the piston structure overcomes the retaining force of the releasable lock.

9. The toe circulation sub of claim 1, wherein the ball retainer allows the ball to act as any of, a permanent plug, stopping flow in both up the bore and down the bore directions, and a one-way check valve, stopping flow in the down direction but allowing flow in the up direction through the bore.

10. A wellbore liner comprising:

a liner string including an outer surface, an inner diameter, a long axis and a distal end;

a toe circulation sub connected at the distal end of the liner string, the toe circulation sub including:

a body with a central bore defining a flow path and a connection connecting the body to the liner string to position the toe circulation sub at the distal end of the wellbore liner;

a piston structure in the body having an axially extending bore and a ball seat wherein upon creation of pressure differential after landing of a ball in the ball seat, the piston structure is axially moveable in the body; and a ball retainer in the path flow adapted to assume:

an inactive position, when the ball retainer assumes a first diameter, wherein fluid is allowed to flow through the flow path into an annulus between the wellbore and the wellbore liner; and an active position, when the ball retainer assumes a second diameter upon axial movement of the piston structure, smaller than the first diameter, wherein flow of fluid through the flow path into an annulus is discontinued the ball being retained in the ball seat, and wherein the ball retainer is to prevent the ball from flowing uphole in the wellbore liner.

11. The wellbore liner of claim 10 wherein the bore is aligned along its full length with the long axis of the liner string.

12. The wellbore liner of claim 10 wherein the bore is linear.

13. The wellbore liner of claim 10 wherein the bore is devoid of fully occlusive diverting surfaces.

14. The wellbore liner of claim 10 wherein the connection to the wellbore liner is provided at the upper end of the body.

15. The wellbore liner of claim 10 wherein the ball retainer includes collet fingers moveable adjacent an open upper end of the bore.

16. The wellbore liner of claim 10 wherein the ball seat has an inner diameter sized to retain the ball in the ball seat to plug flow past the ball.

* * * * *